United States Patent [19]

Hall

[11] Patent Number: 4,999,851

[45] Date of Patent: Mar. 19, 1991

[54] COLLAPSIBLE HAT

[76] Inventor: Douglass A. Hall, David's Hill Rd., Bedford Hills, N.Y. 10507

[21] Appl. No.: 397,555

[22] Filed: Aug. 23, 1989

[51] Int. Cl.[5] ..... A42B 1/20

[52] U.S. Cl. ..... 2/180; 2/175; 2/195

[58] Field of Search ..... 2/180, 209.1, 196, 171, 2/178, 179, 191, 175, 195, 185 B

[56] References Cited

U.S. PATENT DOCUMENTS

| | | | |
|---|---|---|---|
| 232,066 | 9/1880 | Ring | 2/178 |
| 371,970 | 10/1887 | Price | 2/178 |
| 385,410 | 7/1888 | Fry | 2/178 |
| 2,149,468 | 3/1939 | Santise . | |
| 2,437,525 | 3/1948 | Harvel . | |
| 2,495,041 | 1/1950 | Weiss . | |
| 2,845,289 | 7/1958 | Cicogna | 2/180 |
| 3,496,574 | 2/1970 | Liverant . | |
| 4,096,590 | 6/1978 | Keshock . | |

FOREIGN PATENT DOCUMENTS

| | | | |
|---|---|---|---|
| 552569 | 12/1956 | Italy | 2/209.1 |

*Primary Examiner*—William A. Cuchlinski, Jr.
*Assistant Examiner*—C. W. Fulton
*Attorney, Agent, or Firm*—Pennie & Edmonds

[57] ABSTRACT

A collapsible hat comprising a body and a frame, with the frame including a frame member and a connecting device. The body is provided to cover at least a portion of a head of a wearer, and the frame is secured to the body, preferably within a circumferential pocket in the brim, to give the body shape. The main frame member defines a longitudinal axis, has opposite first and second ends, and is shaped into a circular form. The connecting device connects together the first and second ends of the main frame member for rotation about their longitudinal axis.

16 Claims, 3 Drawing Sheets

COLLAPSIBLE HAT

FIELD OF THE INVENTION

This invention generally relates to hats, and more specifically to collapsible hats.

BACKGROUND OF THE INVENTION

Collapsible hats have the advantage that they may be folded to a relatively small, compact size and shape that is easy to carry and to store. Such hats are often provided with a flat metal wire or hoop member in the outer periphery of the hat brim to give the brim a definite shape when worn. These hats are commonly collapsed by twisting the brim in such a manner that three, and only three loops are formed—much as bandsaw blades are packaged. Twisting the brim produces appreciable stresses on the wire. These stresses, of course, are undesirable because they may cause the frame to break prematurely. They also make collapsing the hat more difficult and may cause the hat to open accidentally. Further, unless expensive stainless steel is used—rusting will occur and stain and rot the fabric. In addition, this wire is "hard" and makes for a rigid package when folded.

SUMMARY OF THE INVENTION

It is an object of this invention to provide a collapsible hat having "soft" or resilient brim member. Twisting can produce either two loops or three loops as desired.

Another object of the present invention is to provide a frame for a collapsible hat in which adjacent ends of a main frame member are connected to form a closed, generally circular, hat frame while still allowing relative rotation of the ends of the main frame member about the longitudinal axis thereof in order to provide ease of folding and choice of two "loopings" or three.

Another object of the invention is to provide a rust-free brim member for a collapsible hat —and a soft material that can take a shape when folded not necessarily circular.

These and other objects are attained according to the invention which is of a collapsible hat comprising a body portion, comprising a brim, a wall, a crown, and a frame, with the frame including an elongated, firm yet flexible tubular plastic or wire-like main frame member and means for connecting its ends. The hat body is provided to cover at least a portion of a head of a wearer, and the frame is secured within the brim of the hat to give the hat shape. The brim member is confined within the brim of the hat so as to take a generally circular form. The connecting means connects the first and second ends of the frame member while allowing relative rotation thereof about their longitudinal axis. This arrangement allows the first and second ends of the main frame member to rotate relative to each other, avoiding fatigue and failure of the frame member, as the circular form is twisted into smaller circular forms.

The frame member is made of a wire, e.g., of steel, or of a plastic tubular material, preferably nylon. Its ends may be linked by means allowing relative rotation, or may be constrained to remain together by disposition of the frame member in an elongated pocket extending circumferentially around the hat brim.

DETAILED DESCRIPTION OF THE PREFERRED EMBODIMENTS

Figure 1:
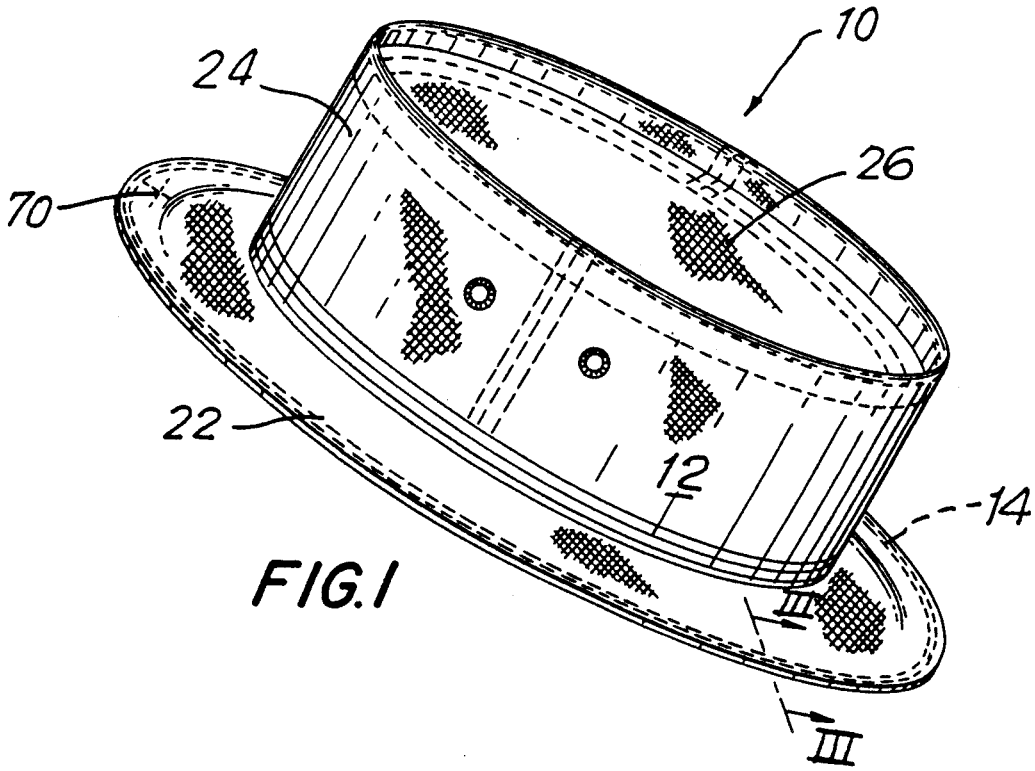
FIG. 1 is a perspective view of a hat in accordance with the present invention.
Figure 2:
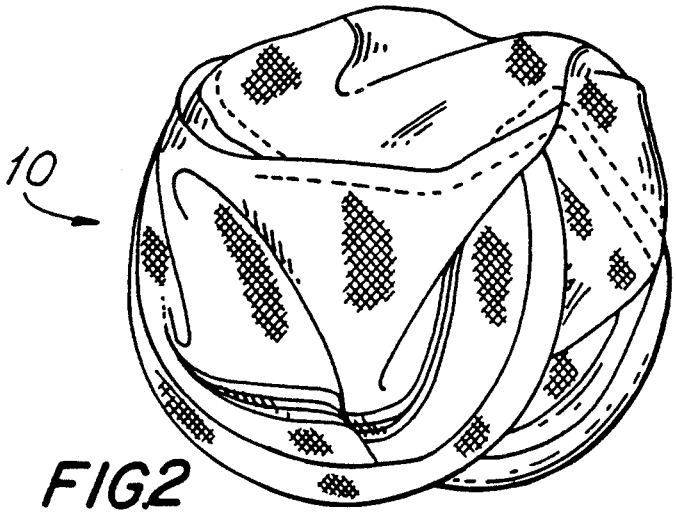
FIG. 2 is a top view of the hat shown in FIG. 1 with the hat in a collapsed position.
Figure 4:
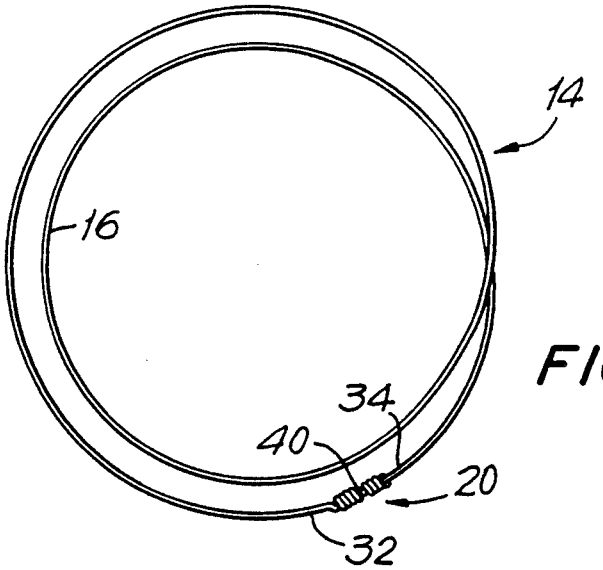
FIG. 4 is a top view of the frame of the hat, showing the shape of the frame when the hat is collapsed.

A collapsible hat 10 embodying the present invention is shown in FIGS. 1 and 2. Hat 10 comprises body 12 and frame 14. Frame 14, as shown in FIG. 4, includes an elongated frame member 14 and connecting means 20. As will be understood, frame member 16 may be made from wire or plastic, or any other suitably bendable but "springy" material, and the frame member may be of any acceptable thickness. Steel wire approximately 0.030" in diameter or ⅛" nylon tubing are suitable materials.

Body 12 is provided to cover at least a portion of a head of a wearer and may be of any suitable shape and style. Preferably body 12 includes brim 22, sidewall 24, and crown 26. Body 12 may be formed from any suitable flexible material. For example, body 12 may be constructed of a natural fabric such as silk, cotton, or wool, or a mixture thereof, or of any acceptable synthetic material.

Figure 3:
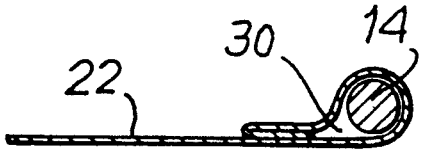
FIG. 3 is a partial cross-sectional view of the brim of the hat, taken along line III—III of FIG. 1.

Frame 14 is secured to body 12 to give the body shape. Frame 14 may be secured to body 12 in a variety of ways. In the embodiment of hat 10 depicted in the drawings, a closed annual pocket or envelope 30, is formed in brim 22 (see FIG. 3), and frame 14 is held therein.

Particularly referring now to FIGS. 1 and 4, elongated main frame member 14 defines a longitudinal axis, has first and second ends 32 and 34, and is normally constrained to take a circular form. In order that the frame can properly give the hat shape, the frame must be constrained to a generally circular shape. "Springy" wire members will take such a shape if their ends are held together. However, in order that the hat can be folded without undue strain on the frame member 14, it is important that its ends be permitted to rotate with respect to one another. Accordingly, connecting means must be provided to keep the ends of the frame together while attempting to rotate with respect to one another.

In a first embodiment, connecting means 20 (see FIG. 4) connects together first and second ends 32 and 34 of main frame member 16 for relative rotation about the longitudinal axis of the main frame member and to form a closed circle, shown in broken lines in FIG. 1. With this arrangement, first and second ends 32 and 34 of main frame member 16 are allowed to rotate relative to each other as hat 10 is collapsed, and specifically as the frame circle shown in FIG. 1 is twisted into smaller, second circles, for example, as shown in FIG. 4. Permitting relative rotation of ends 32 and 34 of frame member 16 reduces the stresses on frame 14 when hat 10 is collapsed. Connecting means 20 preferably holds frame member 16 under slight tension within brim 22, stretching the hat body 12 to its desired shape.

Figure 5:
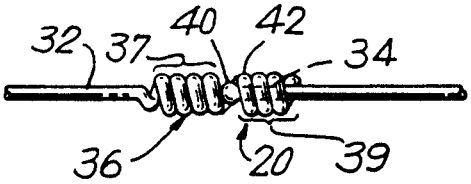
FIG. 5 is an enlarged, front view of one possible connecting means for connecting the ends of the hat frame.

In the embodiment of frame 14 shown in FIGS. 4 and 5, connecting means 20 includes coil 36 and connecting head 40. Coil 36 is integral with first end 32 of main frame member 16 and extends over and around second end 34 of the main frame member. Coil 36 preferably includes a plurality of generally circular volutions divided into two groups 37 and 39 with end 34 extending through volutions 39. Connecting head 40 is integral with second end 34 of frame member 16, and is located between the first and second group of volutions.

In this way, abutting contact between head 40 and first volution 42 of group 39 limits movement of second end 34 of main frame member 16 away from first end 32 thereof, while permitting relative rotation of the ends of the main frame member about their longitudinal axis.

Connecting head 40 preferably is formed after second end 34 of main frame member 16 has been inserted into coil 36, and is formed by peening or otherwise deforming the tip of the second end 34 of the main frame member.

Figure 6:
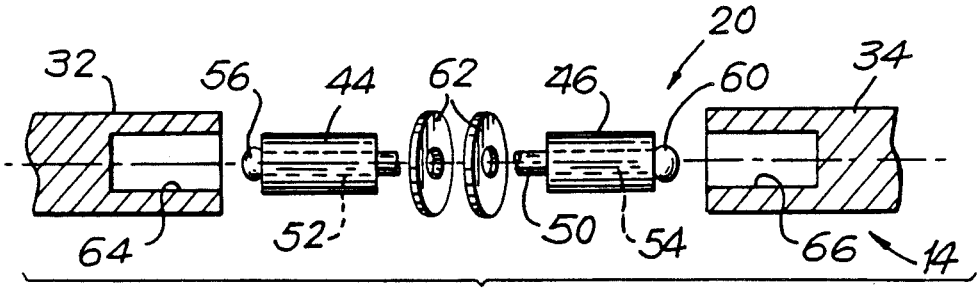
FIG. 6 and 7 are enlarged, exploded views of two alternate means for the ends of the hat frame.
Figure 7:
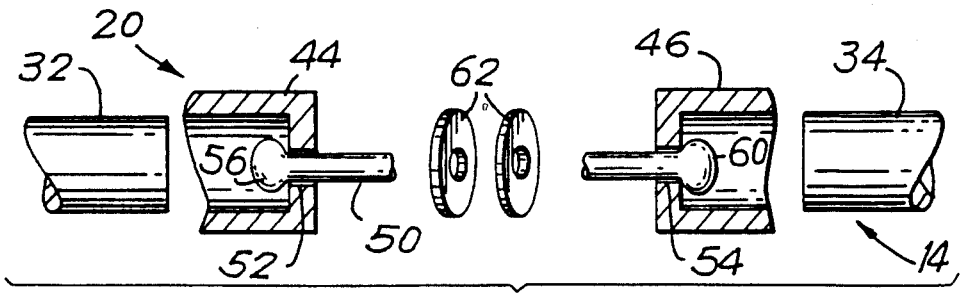

FIGS. 6 and 7 show enlarged, exploded views of two alternate embodiments of connecting means 20. Generally, both of these embodiments include first and second connectors and a two-headed pin. In the embodiment of FIG. 6, first and second connectors 44, 46 extend into and are fixed to tubular end portions 32, 34 of frame member 14. Pin 50 extends through axial apertures in the connectors 44, 46 and is formed to comprise heads 56, 60, which hold the ends 32, 34 of the frame member together. Washers 62 may be provided to reduce friction.

In the embodiment of FIG. 7, the connectors **44*a* and 46*a* fit over the ends 32, 34 of the frame member 14. Pin 50 is peened over within the connectors. Again, this allows relative rotation of ends 32, 34** without releasing them axially from one another.

Figure 8:
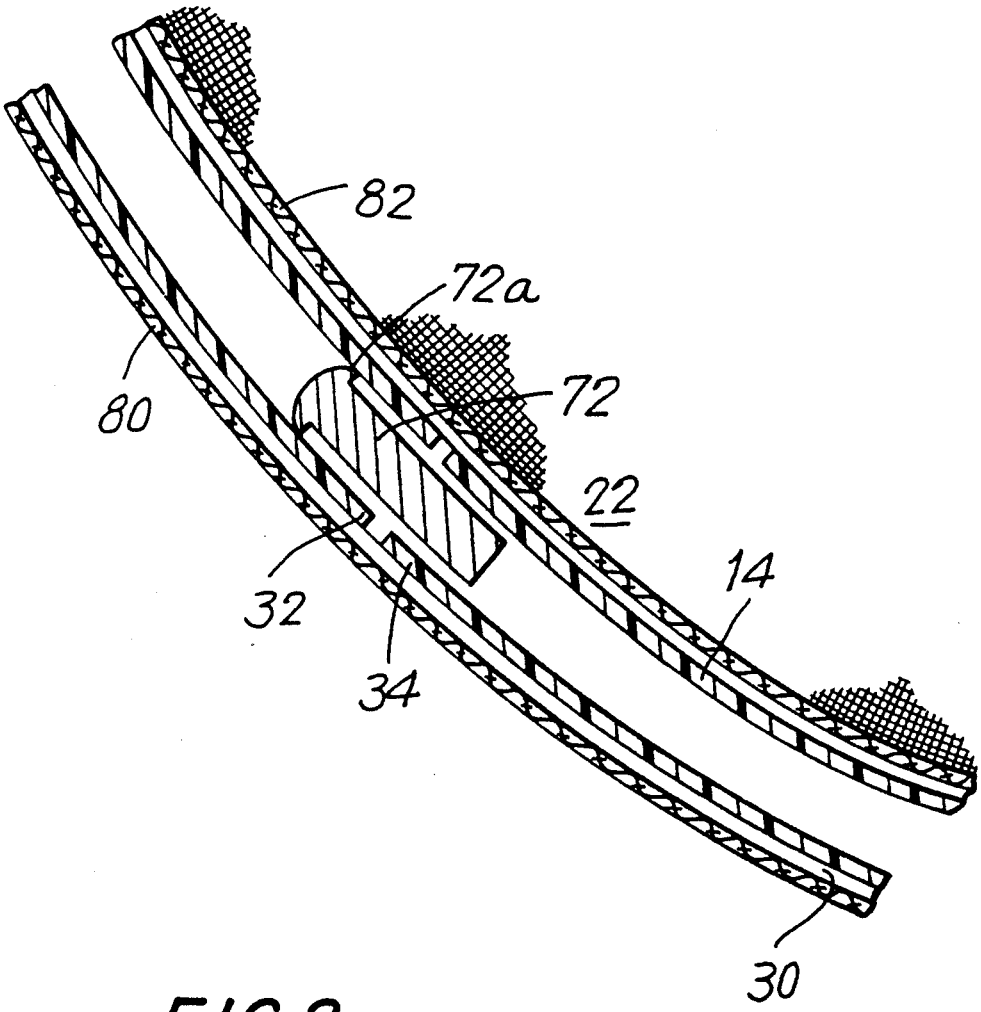
FIG. 8 shows in cross-section yet a further alternate connecting means for the ends of the hat frame.

Another embodiment of connector 20 is shown in FIG. 8. In this embodiment the frame member 14 is of a tubular plastic material, e.g., nylon. This may be desirable to eliminate any possibility of rusting of the frame member, discoloring the hat. A pin 72 of a non-rusting material such as brass is connected into one of the ends 32, 34 of frame member 14 by a friction fit. A head **72*a* may be formed on one end of the pin to ensure that it is retained within the corresponding ends of the frame member 14. The other end of the pin is disposed relatively loosely in the other of the ends 32, 34 of frame 14. Pin 72 prevents the ends 32, 34 from becoming misaligned, and allows relative rotation thereof, but does not keep the ends 32, 34 juxtaposed to one another. This function is performed simply by disposing the nylon frame member 14 in a relatively closely fitting circumferential pocket 30 formed in the brim 22 of the hat. Pocket 30 is shown in FIG. 8 by opposed sections 80, 82** of the material used to form the body of the hat.

Returning to FIG. 1 and 2, to collapse hat 10, frame 14 thereof is first twisted into a FIG. 8 and then the upper and lower halves of the FIG. 8 are folded together. As mentioned connecting means 20 allows first and second ends 32 and 34 of main frame member 16 to rotate relative to each other as frame 14 is twisted into a FIG. 8. This reduces fatigue of frame member 14.

In this example, hat 10 is collapsed by turning the first frame circle, shown in FIG. 1, into two frame circles, shown in FIG. 4, so that each of the second frame circles has a circumference equal to half the circumference of the first frame circle. As will be understood, hat 10 may be designed so that frame 14 may be turned into three loops.

Preferably, when hat 10 is to be twisted into a figure eight, it is turned so that connecting means 20 is located at or adjacent to the point of the figure eight which is common to both the upper and lower halves thereof. This maximizes the rotational forces on the first and second ends 32 and 34 of main frame member 16, at the connecting means 20, which allows the ends of the main frame member to rotate relative to each other around the longitudinal axis of the main frame member. Full advantage of the benefits of the present invention is thus taken. For this reason, with the embodiment of hat 10 described herein, wherein hat frame 14 is hidden from view, the body of hat 10 may be provided with indicia 70 such as a mark stitched into the hat to indicate the specific location of connecting means 20 therein.

With the construction of FIG. 8, the plastic used permits the brim of the hat to be folded into any shape and not particularly a figure eight. The brim can thus be considered soft in that it can be flexed in any direction as desired by the user.

I claim:

1. A collapsible hat comprising:

a body for covering at least a portion of a head of a wearer; and a frame secured to the body to give the body shape and including an elongated frame member defining a longitudinal axis, having first and second opposite ends, and shaped into a circular form, thereby forming a first circle and means connecting together the first and second ends of the frame member for permitting rotation of the first and second ends of the frame member about said longitudinal axis.

2. A collapsible hat according to claim 1 wherein the connecting means includes:

a coil secured to the first end of the frame member and having a first volution, extending over and around the second end of the frame member; and a connecting head secured to the second end of the frame member and located adjacent to the first volution of the coil.

3. A collapsible hat according to claim 1 wherein the connecting means includes:

a first connector secured to the first end of the frame member and defining a first axial opening extending axially of said frame member, a second connector secured to the second end of the frame member and defining a second axial opening extending axially of said frame member, and a pin extending through the first and second axial openings, and having first and second heads beyond the axial openings to limit axial movement of the first and second ends of the frame member.

4. A collapsible hat according to claim 3 wherein the connecting means further includes a was her rotatably supported by the pin and located between the first and second connectors to facilitate relative rotation thereof.

5. A collapsible hat according to claim 1 wherein: the first end of the frame member defines a first socket; the first connector includes a first plug secured within the first socket; the second end of the frame member defines a second socket; the second connector includes a second plug secured within the second socket; and the pin extends through the first and second plugs, and the heads of the pin are located beyond the plugs.

6. A collapsible hat according to claim 1 wherein: the first connector includes a first cap extending over and secured to the first end of the frame member; the second connector includes a second cap extending over and secured to the second end of the frame member; and the pin extends within the first and second caps, and the heads of the pin are captured within the caps.

7. A collapsible hat according to claim 1 wherein the connecting means consists of a swivel joint whereby said first circle may be twisted into two second circles to collapse the hat, each of the second circles having a circumference equal to half the circumference of the first circle.

8. A collapsible hat according to claim 1, wherein said body includes a brim having a circumferential pocket formed therearound, and said frame member comprises a tubular member disposed in said pocket.

9. A hat of claim 8 further comprising a pin extending between the ends of said tubular frame member.

10. A collapsible hat comprising:

a body for covering at least a portion of a head of a wearer; and a frame secured to the body to give the body shape, said frame comprising:

frame member having opposite first and second ends and being shaped into a form defining a first circle;

elongated pin means defining a longitudinal axis substantially coplanar with the first circle and connecting together the first and second ends of the frame member for rotation about the longitudinal axis of the pin means; and means to limit relative axial movement of the first and second ends of the frame member along the longitudinal axis of the pin means.

11. A collapsible hat according to claim 10 wherein:

the body includes a rim defining a circumferential annular envelope, the frame is held within the annular envelope, and the length of the frame member with respect to the annular envelope limits the axial movement of the ends of the frame member.

12. A collapsible hat according to claim 11 wherein the body further includes indicia to indicate the location of the first and second ends of the frame member and the pin means within the body.

means connecting together the first and second ends of the frame member for permitting rotation of the first and second ends of the frame member about said longitudinal axis.

13. A collapsible hat comprising:

a body for covering at least a portion of a head of a wearer; and a frame secured to the body to give the body shape and including an elongated frame member defining a longitudinal axis, having first and second opposite ends, and shaped into a circular form and means connecting together the first and second ends of the frame member for permitting rotation of the first and second ends of the frame member relative to each other, the connecting means including:

a coil secured to the first end of the frame member and having a first volution, extending over and around the second end of the frame volution of the coil; and a connecting head secured to the second end of the frame member and located adjacent to the first volution of the coil.

14. A collapsible hat comprising:

a body for covering at least a portion of a head of a wearer; and a frame secured to the body to give the body shape and including an elongated frame member defining a longitudinal axis, having first and second opposite ends, and shaped into a circular form; and means connecting together the first and second ends of the frame member for permitting rotation of the first and second ends of the frame member relative to each other, the connecting means including:

a first connector secured to the first end of the frame member and defining a first axial opening;

a second connector secured to the second end of the frame member and defining a second axial opening; and a pin extending through the first and second axial openings, and having first and second heads beyond the axial openings to limit axial movement of the first and second ends of the frame member;

the first end of the frame member defines a first socket;

the first connector includes a first plug secured within the first socket;

the second connector includes a second plug secured within the second socket; and the pin extends through the first and second plugs, and the heads of the pin are located beyond the plugs.

15. A collapsible hat comprising:

a body for covering at least a portion of a head of a wearer; and a frame secured to the body to give the body shape and including:

an elongated frame member defining a longitudinal axis, having first and second opposite ends, and shaped into a circular form; and means connecting together the first and second ends of the frame member for permitting rotation of the first and second ends of the frame member relative to each other, the connecting means including:

a first connector secured to the first end of the frame member and defining a first axial opening;

a second connector secured to the second end of the frame member and defining a second axial opening; and a pin extending through the first and second axial openings, and having first and second heads beyond the axial openings to limit axial movement of the first and second ends of the frame member;

the first connector includes a first cap extending over and secured to the first end of the frame member;

the second connector includes a second cap extending over and secured to the second end of the frame member; and the pin extends within the first and second caps, and the heads of the pin are captured within the caps.

16. A collapsible hat comprising:

a body for covering at least a portion of a head of a wearer said body including a brim having a circumferential pocket formed therearound; and a frame secured to the body to give the body shape and including:

an elongated frame member comprising a tubular member disposal in said pocket, said frame member defining a longitudinal axis, having first and second opposite ends, and shaped into a circular form, and pin means extending between the end of the tubular frame member and connecting together the first and second ends of the frame member for permitting rotation of the first and second ends of the frame member about said longitudinal axis.

* * * * *